United States Patent [19]

Dröscher et al.

[11] 4,351,564

[45] Sep. 28, 1982

[54] DEVICE FOR PREVENTING COLLISION BETWEEN PART OF THE CUTTING ARM AND PART OF THE LOADING RAMP FOR A CUTTING MACHINE

[75] Inventors: Erich Dröscher, Scheifling; Hans P. Pfundner, Weisskirchen; Herwig Wrulich, Zeltweg, all of Austria

[73] Assignee: Voest-Alpine Aktiengesellschaft, Vienna, Austria

[21] Appl. No.: 202,001

[22] Filed: Oct. 28, 1980

[30] Foreign Application Priority Data

Nov. 5, 1979 [AT] Austria ..... 7097/79

[51] Int. Cl.³ ..... E21C 27/24

[52] U.S. Cl. ..... 299/1; 299/64; 299/75

[58] Field of Search ..... 299/1, 64, 75, 76

[56] References Cited

U.S. PATENT DOCUMENTS 3,282,627 11/1966 Arndt ..... 299/1

4,023,861 5/1977 Schnell ..... 299/1

4,070,063 1/1978 Kogler et al. ..... 299/75 X 4,108,494 8/1978 Kogler ..... 299/1

*Primary Examiner*—Ernest R. Purser

*Attorney, Agent, or Firm*—Cushman, Darby & Cushman

[57] ABSTRACT

The device for preventing a collision between a part of the cutting arm (1) and a part of the loading ramp (4) comprises transmitter means (11, 12) designed as hydraulic cylinder-piston-arrangements (13, 14; 19, 21) checking the position of the cutting arm (1) and the loading ramp (4) relative to the cutting machine. The working spaces (24, 29) of the transmitter means (11, 12), which become reduced on downward movement of the cutting arm (1) and on upward movement of the loading ramp (4), are connected via conduits with the working space (27) of a hydraulic piston (31) forming the receiver means (28). The piston (31) is, when be shifted, actuating a switching member (34) for interrupting the movements of the cutting arm (1) and of the loading ramp (4) (FIG. 2).

6 Claims, 3 Drawing Figures

FIG. 1
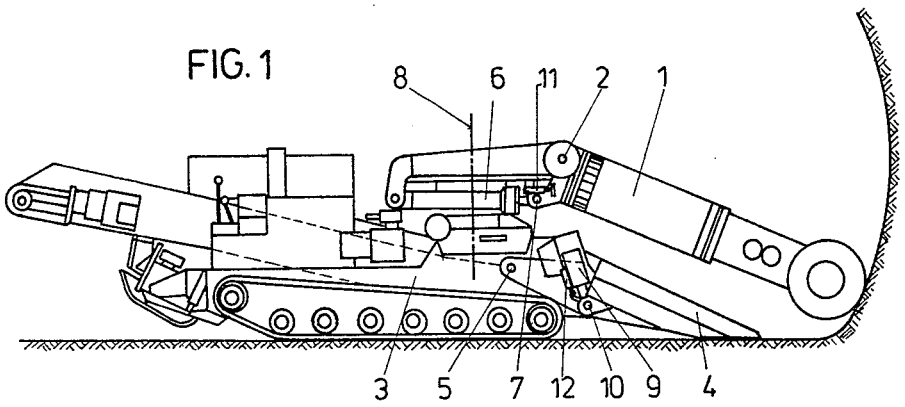
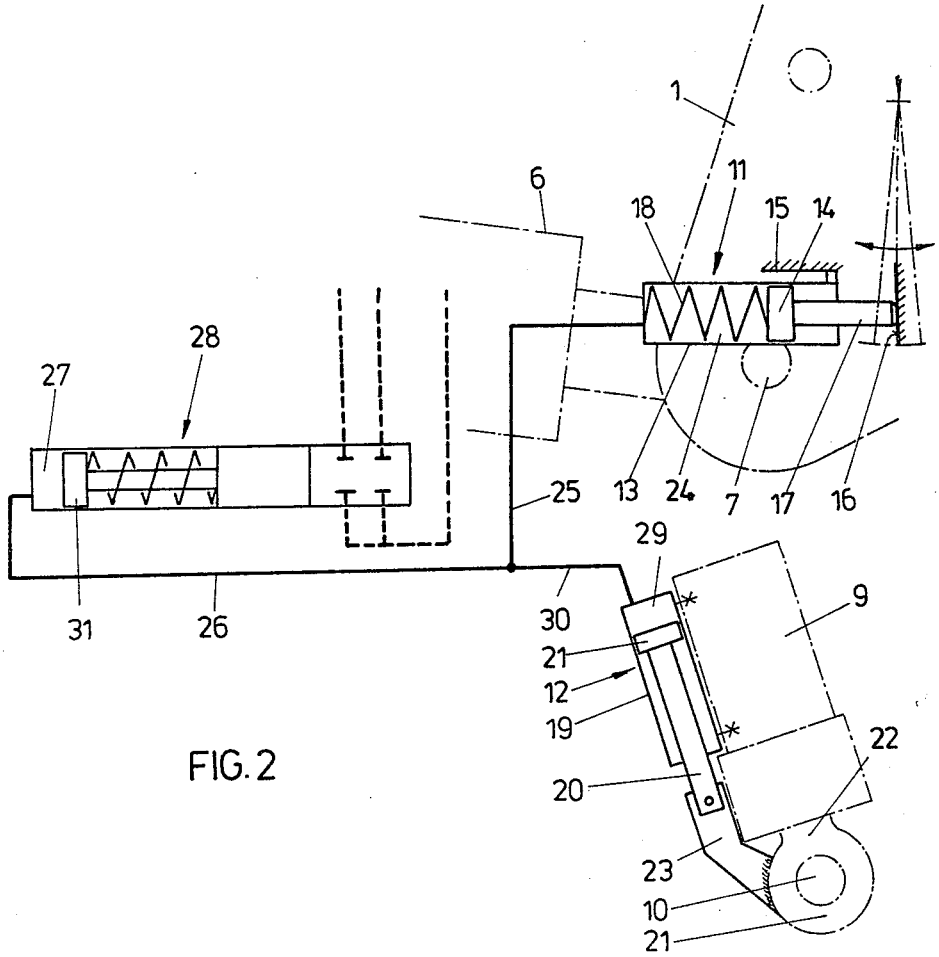
FIG. 2

DEVICE FOR PREVENTING COLLISION BETWEEN PART OF THE CUTTING ARM AND PART OF THE LOADING RAMP FOR A CUTTING MACHINE

The present invention refers to a device for preventing collision between part of the cutting arm and part of the loading ramp for a cutting machine comprising a pivotable cutting arm pivotable around at least one horizontal axis and carrying at least one cutting head and comprising a loading ramp arranged below the cutting arm and designed to be lifted and lowered. In such cutting machines, the cutting arm is universely pivotably supported and the loading ramp is pivotably linked to the frame of the cutting machines for pivotal movement around an horizontal axis. If now the cutting arm is pivoted in downward direction and/or the loading ramp is lifted, there results the danger of a collision between the cutting arm and the loading ramp. As a rule, the loading ramp is provided with movable loading arms which continuously shift the cut material in upward direction to a conveyor means. If the cutting arm collides with these loading arms, the danger of damaging the device is particularly severe. For preventing such a collision of the cutting arm with sensible constructional parts, for example with the movable loading arms, it is known to provide on the cutting arm and on the loading ramp abutments of such a height that any contact between cutting arms and loading arms is prevented in all pivotal positions thereof. With such a construction, said abutments must carry the whole load exerted by the pivoting mechanism and for preventing this phenomenon it has already been proposed to make one of these abutments movable and to actuate by this movable abutment a control valve which connects the hydraulic conduit, on the one hand, being pressurized on downward pivotal movement of the cutting arm, and the hydraulic conduit, on the other hand, being pressurized on upward pivotal movement of the loading ramp with a backflow conduit for interrupting the pivotal movement of the cutting arm as well as of the loading ramp. In any case, such abutments are required on the surface of the loading ramp and are to be given such a breadth that they can be effective in all lateral pivotal positions of the cutting arm. Such abutments in turn are therefore forming obstacles on the surface of the loading ramp and subject to collide with the material to be conveyed. If such abutments are retaining on the loading ramp bigger parts of the material to be conveyed, there again results the danger that such bigger parts are contacting abutments provided on the cutting arm and thus are interrupting the propelling means for the cutting arm and for the loading ramp in an undesired position. There exists also the possibility to increase the pivotal range and the length of the cutting arm to be in the position to effect cutting work over a greater cutting area. In this case, there exists already substantial difficulties to prevent collisions by abutments arranged on the loading ramp and on the cutting arm. The abutments would have to be exchanged with substantial work expenditure and the abutments would have to be given an excessive height which would result in further disturbances.

The invention has as an object to provide a device for avoiding collisions between cutting arm and loading ramp without affecting the loading surface of the loading ramp and which device shall easily be adaptable to the existing conditions. The invention essentially consists in that a transmitter means is provided for the cutting arm, said transmitter means registering the position of the cutting arm relative to the cutting machine, and a transmitter means is provided for the loading ramp, said transmitter means registering the position of the loading ramp relative to the cutting machine, and in that said both transmitter means are in connection with a common receiver means controlling a switching member interrupting the downward movement of the cutting arm and the upward movement of the loading ramp in dependence on a combination of the signals of said both transmitter means. In this manner, abutments on the cutting arm and abutments on the loading ramp cooperating with the abutments on the cutting arm are avoided so that the loading surface of the loading ramp is not affected. In view of both transmitter means being in connection with a common receiver means and in view of the signals of both transmitter means being combined in said receiver means, the device according to the invention gives a response on occasion of a dangerous proximity between the cutting arm and the loading ramp independent of whether this proximity results when lowering the cutting arm or results when lifting the loading ramp or when both said movements occur simultaneously.

According to a preferred embodiment of the invention, the transmitter means are formed of hydraulic cylinder-piston-arrangements, one part of which being connected with a part of the cutting machine and the other part of which being, at least within the lower portion of the pivotal movement of the cutting arm, acting on the loading ramp and the cutting arm, noting that the working space of said both cylinder-arrangements becoming reduced on downward movement of the cutting arm and on upward movement of the loading ramp, respectively, are connected with the working space of a hydraulic piston forming the receiver means and being in connection with the switching member interrupting the movements of the cutting arm and of the loading ramp. In view of the hydraulic fluid being pressed out of the cylinder-piston-arrangements forming said both transmitter means into a common space, i.e. into the working space of the hydraulic piston forming the receiver means, the receiver means is controlled in dependence on the sum of the movements, turned to each other, of the cutting arm and of the loading ramp and the sum of said mentioned movements is decisive for any possible collision position. It is only required that the amount of hydraulic fluid pressed into said common working space corresponds to the path of movement of the corresponding part of the cutting arm and of the loading ramp. With equal kinematics of the areas of engagement of both cylinder-piston-arrangements, the cross sections of the pistons can be equal in size. It is, however, also possible that the cross sections of the pistons and the kinematics of the connecting links when registering the movements of the cutting arm and of the loading ramp are differing. It is only decisive that the amounts of hydraulic fluid pressed into the working space of the piston of the receiver means on movement of said both parts are proportional to said movements.

According to the invention, the working spaces of the cylinder-piston-arrangements and of the piston forming the receiver means are filled with an empirically established amount of a hydraulic fluid, particularly grease. When using grease as the hydraulic medium there results the advantage that more simple seals can be used. The amount of hydraulic fluid to be filled into the working spaces can be empirically established in a simple manner by transferring the cutting arm and the loading ramp into a position close prior to collision and then filling the mentioned working spaces with the hydraulic medium. The pivotal means of the cutting arm, can, as already mentioned, be increased in height. This increase in height can be up to 800 mm or more. By the amount of hydraulic fluid introduced, this increase in height can be taken into consideration in a simple manner, so that adjustment of the device for preventing a collision is extremely simple also when increasing the height of the pivotal means.

Preferably the arrangement is such that the transmitter means associated to the cutting arm or the cylinder-piston-arrangement, respectively, is, on the other hand, fixedly connected to a part of the cutting machine and is, on the other hand, acting on a part of the cutting arm by contact or impact only, said contact only becoming effective with the cutting arm being within the lower half of the vertical pivotal area. The cutting arm performs a relatively vast pivotal movement in height direction and it is only in the lower portion of the pivotal area of the cutting arm that there exists the danger of a collision. In contrast thereto, the loading ramp is performing only a relatively small pivotal movement in height direction and there exists the danger of a collision in all pivotal positions of the loading ramp. In view of the transmitter means associated with the cutting arm only becoming effective within the lower portion of the vertical pivotal path of the cutting arm, the pivotal path checked by the transmitter means for the cutting arm can be made approximately equal the pivotal path of the loading ramp, so that said both pivotal paths can be summed up without further.

When hydraulically actuating the cutting arm and the loading ramp, the switching member is preferably formed of a piston valve having its control piston provided with control recesses which simultaneously establish a connection of the hydraulic conduit for lowering the cutting arm and the hydraulic conduit for lifting the loading ramp with a back-flow conduit. In this case, the control piston of the piston valve is conveniently coaxially connected with the hydraulic piston forming the receiver means, or is integral therewith.

In the drawing, an embodiment of the invention is schematically shown.

FIG. 1 shows a cutting machine,

FIG. 2 shows the arrangement of the hydraulic cylinder-piston-arrangements forming the transmitter means and of the piston forming the receiver means and FIG. 3 shows the hydraulic piston forming the receiver means together with the control slide valve.

Figure 3:
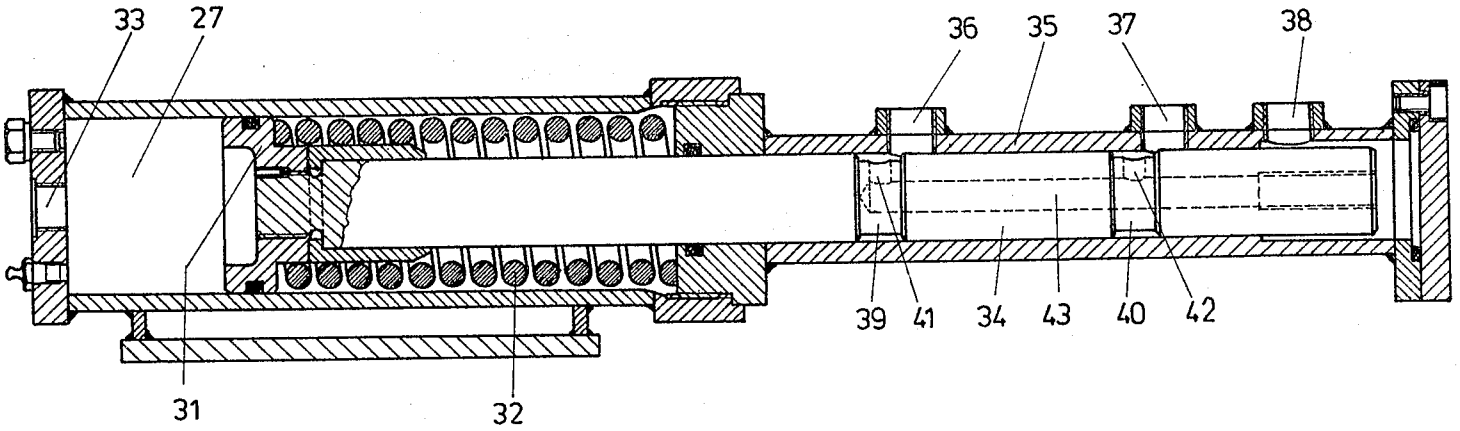

The cutting arm 1 is pivotally connected to the cutting machine 3 for being lifted and lowered by pivotal movement around a horizontal axis 2. The loading ramp 4 is pivotally linked to the cutting machine 3 and can be pivoted around a horizontal axis 5. The cutting arm is pivoted around the axis 2 by means of a cylinder-piston-arrangement 6 linked to the cutting arm 1 at 7. The cutting arm 1 can also laterally be swivelled around a vertical axis 8. A hydraulic cylinder-piston-arrangement 9 acting on the loading ramp 4 at 10 for swivelling the loading ramp in height direction is provided.

A transmitter means 11 formed of a hydraulic cylinder piston arrangement is associated with the cutting arm and a transmitter means 12 formed of a hydraulic cylinder-piston-arrangement is associated with the loading ramp. These transmitter means are shown in FIG. 2 in a greater scale.

The transmitter means 11 consists of a cylinder-piston-arrangement, the cylinder of which is designated 13 and the piston of which is designated 14. The cylinder 13 is stationarily arranged on a part connected with the cutting machine as this is indicated at 15. The cutting arm 1 has an abutment 16 on which is acting the piston rod 17 of the piston 14. The piston 14 is pressed in direction to the abutment 16 by a spring 18. The path of the piston 14 is limited such that the piston rod 17 contacts the abutment 16 only if the cutting arm is within the lower portion of its vertical pivotal area. The hydraulic cylinder 9 linked to the loading ramp 4 at 10 is fixed to the cutting machine. The cylinder 19 of the cylinder piston arrangement forming the transmitter means 12 is fixed to the cylinder 9 and thus also on the cutting machine itself. The piston rod 20 of the cylinder-piston-arrangement 12 is fixedly connected with an eye 21, acting on the loading ramp, of the piston rod 22 of the cylinder of the cylinder-piston-arrangement 9 with interposition of a constructional part 23 welded to this eye 21. Thus, no spring-load is required.

On downward pivotal movement of the cutting arm 1, the piston space 24 of the cylinder-piston-arrangement 11 becomes reduced and hydraulic fluid, for example grease, is pressed via a conduit 25, 26 into the working space 27 of a cylinder-piston-arrangement 28 forming the receiver means. On upward movement of the loading ramp, the working space 29 of the piston 21 of the cylinder-piston-arrangement 12 forming the transmitter means associated with the loading ramp becomes reduced. The hydraulic medium is then pressed via the conduit 30, 26 also into the working space 27 of the cylinder-piston-arrangement 28 forming the receiver means. Hydraulic fluid is thus pressed into the working space 27 when lowering the cutting arm 1 as well as when lifting the loading ramp 4 so that the piston 31 of the cylinder-piston-arrangement 28 forming the receiver means is pressed in right-hand direction for a path corresponding to the sum of the displaced volumes of hydraulic fluid. The shifting path of the piston 31 in right-hand direction is thus dependent on the downward movement of the cutting arm as well as on the upward movement of the loading ramp and when the sum of the volumes of hydraulic fluid displaced from the cylinder piston arrangements 11 and 12 assumes a value corresponding to a dangerous proximity of cutting arm and loading ramp downward movement of cutting arm and upward movement of loading ramp is stopped by the piston 31.

The corresponding arrangement is shown in FIG. 3. The piston 31 is biased in left-hand direction by a spring 32. The conduit 26 is opening into the working space 27 of this piston via a connecting piece 33. A control piston 34 is connected with the piston 31 and slidable within a valve bushing 35. The control opening 36 is in connection with that hydraulic conduit which is responsible for lowering the cutting arm 1. The control opening 37 is in connection with that hydraulic conduit which is responsible for lifting the loading ramp 4. The control opening 38 is in connection with a back-flow conduit. The control piston 34 has control recesses 39 and 40 which are via radial bores 41 and 42 connected with a central bore 43 of the control piston 34. As soon as these control groves 39, 40 coincide with the control openings 36 and 37, said control openings are in connection with the control opening 38 via the control recesses 39, 40, the radial bores 41 and 42 and the central bore 43. The hydraulic conduits for lowering the cutting arm and for lifting the loading ramp are both connected with the back-flow-conduit via the control opening 38 so that the downward movement of the cutting arm and simultaneously also the upward movement of the loading ramp is stopped, thus avoiding any collision.

What is claimed is:

1. Device for preventing collision between a part of the cutting arm and a part of the loading ramp in a cutting machine comprising a pivotable cutting arm pivotable at least around one horizontal axis and carrying at least one cutting head and comprising a loading ramp arranged below the cutting arm and being designed to be lifted and lowered, characterized in that a transmitter means is provided for the cutting arm, said transmitter means registering the position of the cutting arm relative to the cutting machine, and a transmitter means is provided for the loading ramp, said transmitter means registering the position of the loading ramp relative to the cutting machine, and in that said both transmitter means are in connection with a common receiver means (28) controlling a switching member interrupting the downward movement of the cutting arm and the upward movement of the loading ramp in dependence on a combination of the signals of said both transmitter means.

2. Device as claimed in claim 1, characterized in that said transmitter means are formed of hydraulic cylinder-piston-arrangements, one part of which is connected with a part of the cutting machine and the other part of which is, at least within the lower portion of the pivotal area of the cutting arm, acting on the loading ramp and on the cutting arm, and in that the working spaces of said both cylinder-piston-arrangements becoming reduced on downward movement of the cutting arm and on upward movement of the loading ramp, respectively, are connected with the working space of a hydraulic piston forming the receiver means is in connection with the switching member interrupting the movements of the cutting arm and of the loading ramp.

3. Device as claimed in claim 1 or 2, characterized in that the working spaces of the cylinder-piston-arrangements and of the piston forming the receiver means are filled with an empirically established amount of a hydraulic fluid, particularly grease.

4. Device as claimed in any of claims 1 or 2 characterized in that the transmitter means associated with the cutting arm or the cylinder-piston-arrangement, respectively, is, on the one hand, fixed to the cutting machine or on a part connected thereto and is, on the other hand, acting on the cutting arm or on a part connected thereto by contact or impact only, said contact or impact only becoming effective with the cutting arm being within the lower half of its vertical pivotal area.

5. Device as claimed in claim 1 or 2, characterized in that when hydraulically driving the movement of the cutting arm and the loading ramp, the switching member is formed of a piston valve provided with control recesses which simultaneously establish a connection of the hydraulic conduit for lowering the cutting arm and of the hydraulic conduit for lifting the loading ramp with a backflow conduit.

6. Device as claimed in claim 5, characterized in that the piston valve is coaxially connected with the hydraulic piston forming the receiver means or is forming one single part with said hydraulic piston.

* * * * *